United States Patent [19]

Jones

[11] 4,133,295

[45] Jan. 9, 1979

[54] CATTLE GATE FOR RODEO

[76] Inventor: Ernest L. Jones, Rte. 1, Box 128, Cedaredge, Colo. 81413

[21] Appl. No.: 815,984

[22] Filed: Jul. 15, 1977

[51] Int. Cl.[2] ..... A01K 1/00

[52] U.S. Cl. ..... 119/15.5 R; 119/98; 49/109

[58] Field of Search ..... 119/15.5 R, 15.5 A, 119/98; 49/109, 110

[56] References Cited

U.S. PATENT DOCUMENTS

| | | | |
|---|---|---|---|
| 190,715 | 5/1877 | Goldsworthy | 49/110 |
| 835,984 | 11/1906 | Reis | 49/109 |
| 1,046,916 | 12/1912 | Wegner | 49/109 |
| 2,560,116 | 7/1951 | Lucas et al. | 119/15.5 R |
| 2,642,840 | 6/1953 | Hill et al. | 119/98 |

*Primary Examiner*—Russell R. Kinsey
*Assistant Examiner*—Daniel J. Leach

[57] ABSTRACT

A gated, cage-like enclosure device adapted to receive, confine and quickly release a steer or a calf and especially constructed for use in the performance of certain rodeo contests, such as, by way of example, those known as bulldogging, steer-roping, and calf-roping. The enclosure device has an improved lever and link mechanism for readily opening and closing the exit gates and holding the exit gates locked when in closed position. The enclosure device also has adjustable side walls for accommodating animals of different sizes and in addition means for operating an entrance gate with greater ease than has been possible with prior art devices.

9 Claims, 8 Drawing Figures

FIG. 6
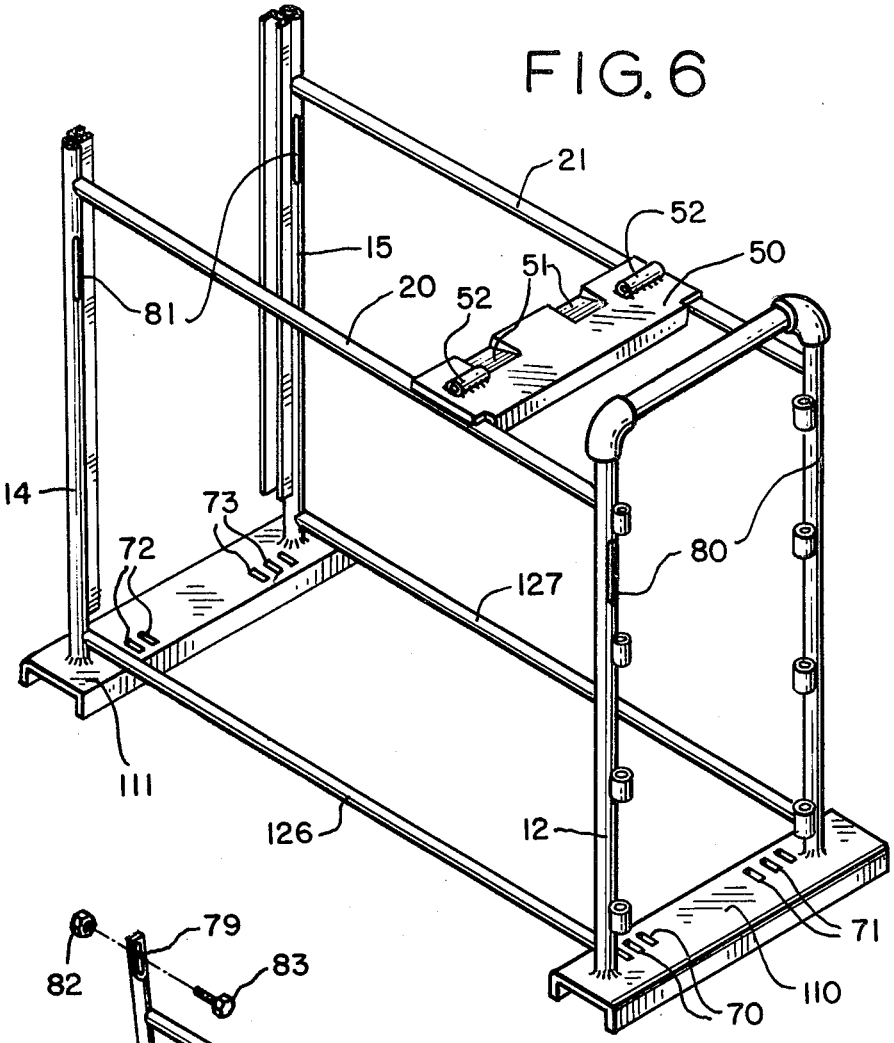
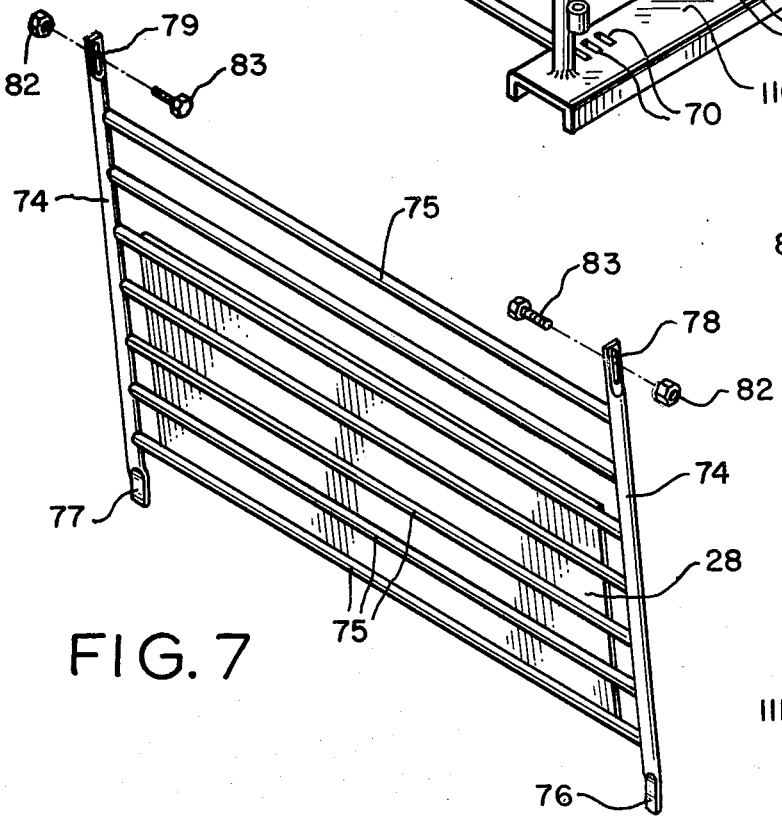
FIG. 7
FIG. 8
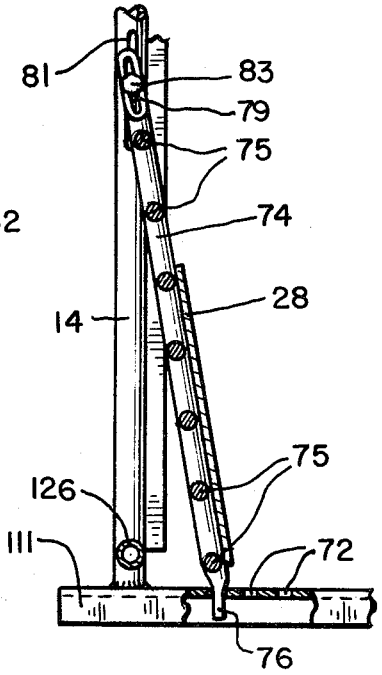

CATTLE GATE FOR RODEO

BACKGROUND OF THE INVENTION

Rodeo contests have become popular in recent years, particularly in the western states of the United States, and many cowboys and other western riders have become highly skilled in the performance of certain cattle handling feats, such as bulldogging, steer-roping, and calf-roping. The riders exhibit their skills in performing these feats when they actively compete with each other for prize money before large audiences during rodeo performances.

Ideally, the execution of these events requires that a steer or a calf be brought into a suitable enclosure having a gate which can be readily opened and closed for the entrance and retention of the animal; that the steer or calf be safely confined within the enclosure and restrained therein without danger of injury for a short period during which the cowboy or cowboys and their horses are taking their appropriate places and are making ready for the impending event, and that, finally, the steer or calf be suddenely released, without danger of injury, into the rodeo arena where the feat of bulldogging, steer-roping, or calf-roping, as the case may be, is to be performed.

THIS INVENTION

It is an object of this invention to provide an enclosure device for the above-stated purpose that has a new and improved construction and possesses novel features.

It is a further object of this invention to provide a new and improved exit gate control mechanism for such a device which is simple in its action of holding the gates shut and of quickly opening to release the animal and yet is foolproof in all attitudes of its operation. This improvement employs a lever and link mechanism which utilizes a motion, when closing the gates, which brings the lever and link parts to relative positions slightly beyond dead center whereby to effect a positive locking action for the exit gates, and yet which by a slight manually applied movement can be caused to return to and pass dead center, and thereby to assume positions which allow the gates to freely open and thereby to quickly free the confined animal. Here again, the opening and closing actions are easily effected with a minimum of force while achieving, with high efficiency, the intended and desired action.

It is a further object of this invention to provide adjustable side walls for an enclosure of the type here described, which make it possible to narrow or widen the space between the side walls at their tops. This feature permits a quick change to be made for animals of different sizes both with respect to their body widths, and with respect to the space between the confining walls adjacent the feet of the animals.

Another object of this invention is to provide an entrance gate which is controlled by hand with great ease and with little force, whereby the act of admitting and confining an animal can be accomplished by anyone — even a child.

These and other objects not specifically enumerated, are contemplated for this invention as will readily appear to one skilled in this art as the following description proceeds.

DESCRIPTION OF ONE FORM OF THE INVENTION

In order to better understand this invention, one preferred form of the invention will now be described with reference to the accompanying drawings, in which:

FIG. 6 is a perspective view of the frame of a modification of the invention which is constructed to accommodate side walls which are adjustable at the top and bottom, whereby the width of the space between the side walls may be varied to accommodate animals of different sizes.

FIG. 7 is a perspective view of one of the adjustable side walls adapted to be used with the frame of FIG. 6 removed from the assembly in order to better show its construction.

FIG. 8 is a fragmentary elevational view partly in cross-section showing one of the adjustable walls like that shown in FIG. 7 when installed with the frame of FIG. 6.

THE PREFERRED CONSTRUCTION OF THIS INVENTION

Figure 1:
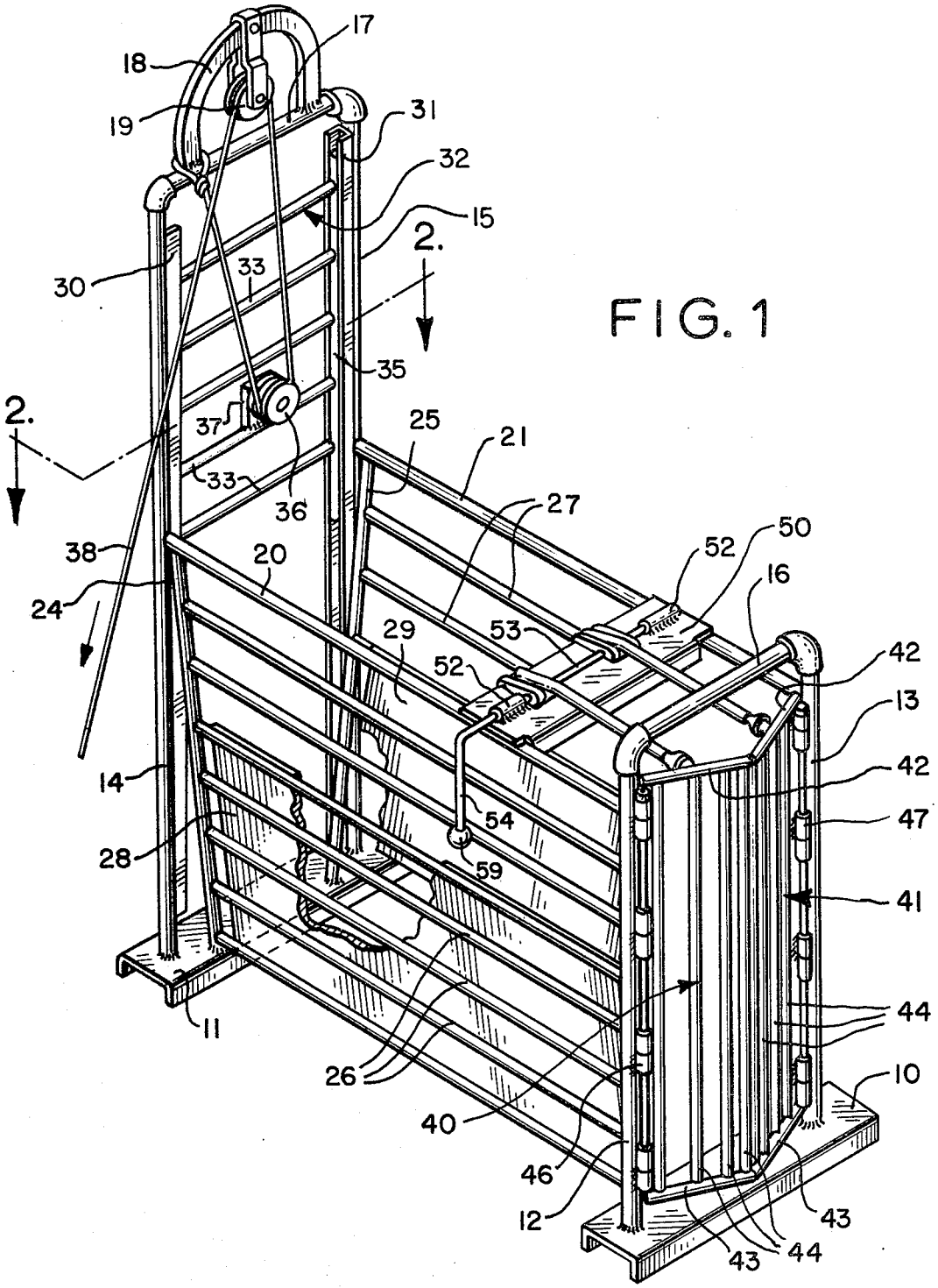
FIG. 1 is a perspective view of one form of an enclosure device constructed in accordance with this invention.
Figure 2:
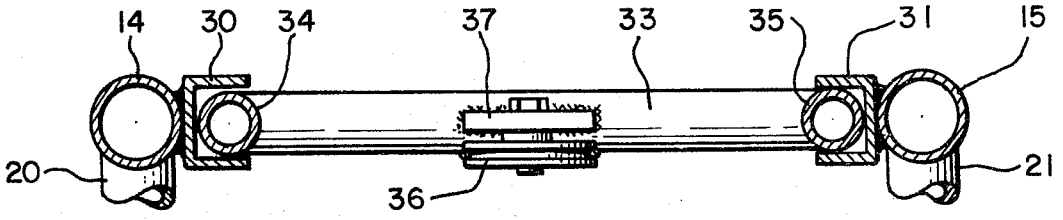
FIG. 2 is a cross-sectional view of the entrance gate taken on the line 2—2 of FIG. 1 and looking in the direction of the arrows showing the slide construction for accommodating the sliding entrance gate.

The device illustrated in FIG. 1 comprises a pair of base members 10 and 11. On base member 10 are mounted a pair of upright corner posts 12, and 13 attached in any suitable manner as by welding. The upper ends of corner posts 12 and 13 are attached to a cross member 16 by welding or by any other suitable means such as pipe connectors as shown. On base member 11 a pair of upright corner posts 14 and 15 are mounted, these, however, preferably extend upwardly higher than the corner posts 12 and 13 for the purpose of accommodating the entrance gate in a manner hereinafter described. The upper ends of corner posts 14 and 15 are attached to a cross member 17 in the manner illustrated, and on top of member 17 a yoke 18 with an attached pulley 19 is mounted in the manner shown. Extending between corner posts 12 and 14 is a horizontal rail member 20 attached in any suitable manner and similarly between corner post 13 and 15 horizontal rail member 21 is attached. Extending between the base member 10 and the rails 20 and 21 respectively are upwardly extending posts 22 and 23 (See FIG. 3) preferably mounted at an angle as shown so as to restrict somewhat the width of the inside space of the device at the ground level. Similarly posts 24 and 25 are attached respectively between the base member 11 and rails 20 and 21, and also are positioned at an angle as shown corresponding to the angle of posts 22 and 23 respectively. Extending between posts 22 and 24 are a plurality of horizontal rails 26 provided in sufficient number to form a suitable enclosure of the type herein referred to. Between posts 23 and 25 are a plurality of horizontal rails 27 corresponding to the rails 26 on the opposite side of the enclosure.

It should be understood that the posts and rails above described can be of any suitable cross-sectional shape and made of any material which is sufficiently durable and strong. It has been found, for instance, that hollow metal piping of suitable diameter may be employed and in such case the attachment of the parts may be effected by welding or if desired by pipe-fitting attaching means consisting of threaded collars, corners, brackets and the like. In use, the device is placed on the ground and preferably the base members 10 and 11 are set in the ground with their upper surfaces flush with the ground surface. In this way an animal, when occupying the enclosure, stands on the ground and because the base members are set into the ground, the animal may walk freely into and out of the enclosure and in so doing pass over the base members 10 and 11 without danger of interference from the base members. It will be apparent that the structure so constituted will be strong and durable and will serve well in its intended use.

Attached to the horizontal rails 26 and 27 are shield members 28 and 29 respectively of suitable material, located adjacent the lower portion of the side walls so as to prevent the animal in the enclosure getting its foot or leg between the rails of the side walls. These shield members may be made of board material such as plywood or the like but preferably are composed of old belting materials of leather or heavy fabric of sufficient width to provide the desired protection.

At the entrance end of the enclosure a gate slide is provided which consists of two U-shape upright members 30 and 31 mounted respectively to the corner posts 14 and 15 disposed so that their open sides face each other. This slide accommodates a gate 32 consisting of uprights 34 and 35 and cross members 33 preferably constructed as shown in FIG. 1 and of a size to freely slide up and down in the U-shaped members 30 and 31. The entrace gate 32 also has a pulley 36 mounted on a support 37 suitably fixed to a portion of the gate 32. Pulley 36 is preferably positioned with respect to pulley 19 mounted above so as to accommodate a line 38, one end of which is tied or otherwise fastened to the frame, such as to yoke 18, and then passed over pulleys 36 and 19 respectively with the other end extending downwardly to be grasped by the operator of the entrance gate. The free end of the line 38 can be conveniently tied to one of the side wall horizontal rails 20 or 26 when the gate is to be held in elevated position. By virtue of the fact that the pulley arrangement provides an effective mechanical advantage the entrance gate can be raised or lowered with great facility and little exertion.

Figure 3:
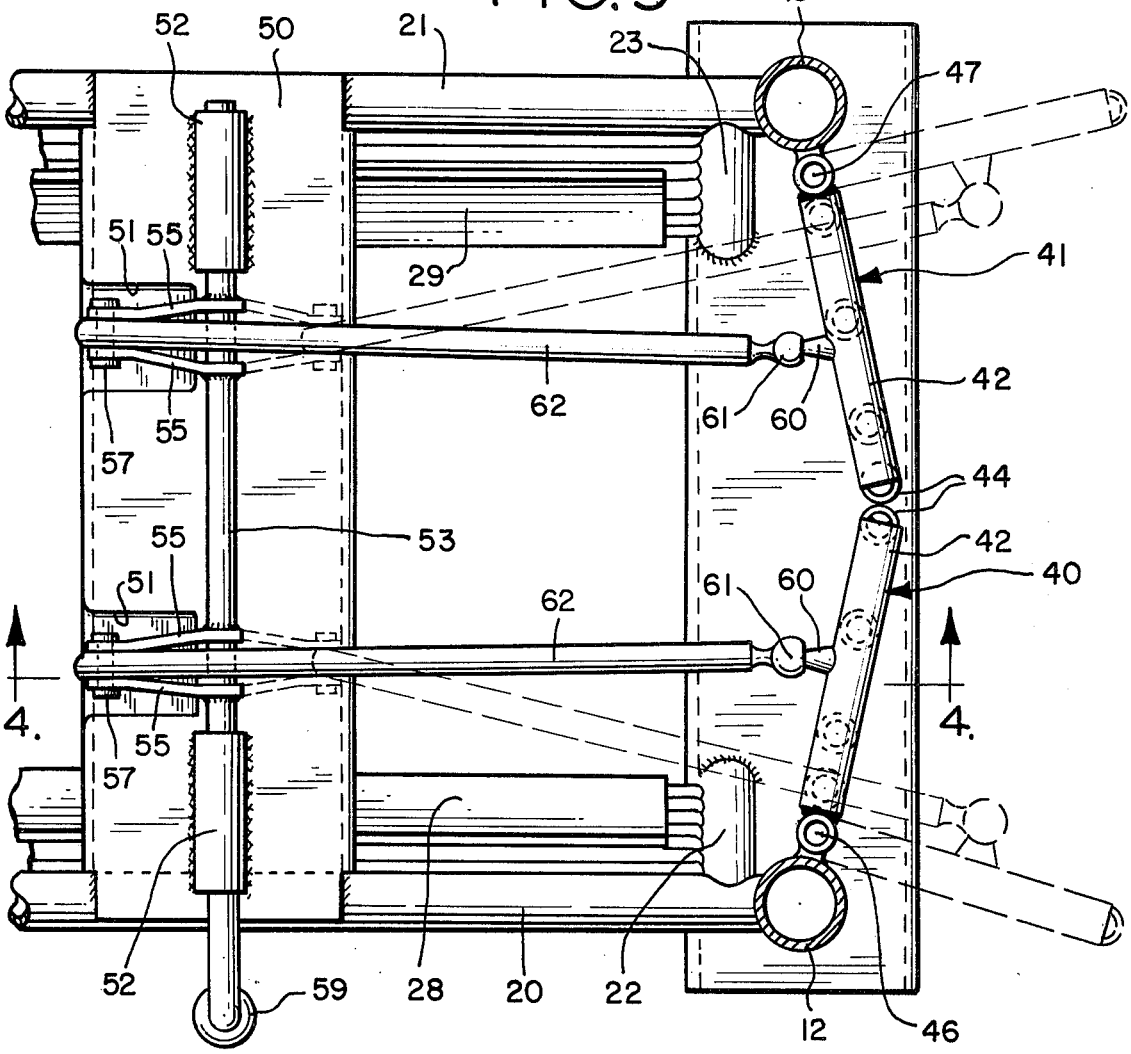
FIG. 3 is an enlarged plan view of the lever and link mechanism shown in FIG. 1 for opening and closing the exit gates, with the parts in closed-gate position.

At the exit end of the enclosure device are a pair of hinged gate members 40 and 41 each preferably made of horizontally disposed tubular rails 42 and 43 at the top and bottom respectively and vertical bars 44 connected by welding or other suitable means, all as illustrated in FIG. 1 of the drawings. The exit gate members are hinged respectively to the posts 12 and 13 by means of hinges 46 and 47 so that the gates when in closed position have their adjacent vertical bars 44—44 brought into contact or nearly so as shown in FIG. 3 and at the same time be capable of swinging to open position as represented by the phantom portion of the illustration in FIG. 3.

Figure 4:
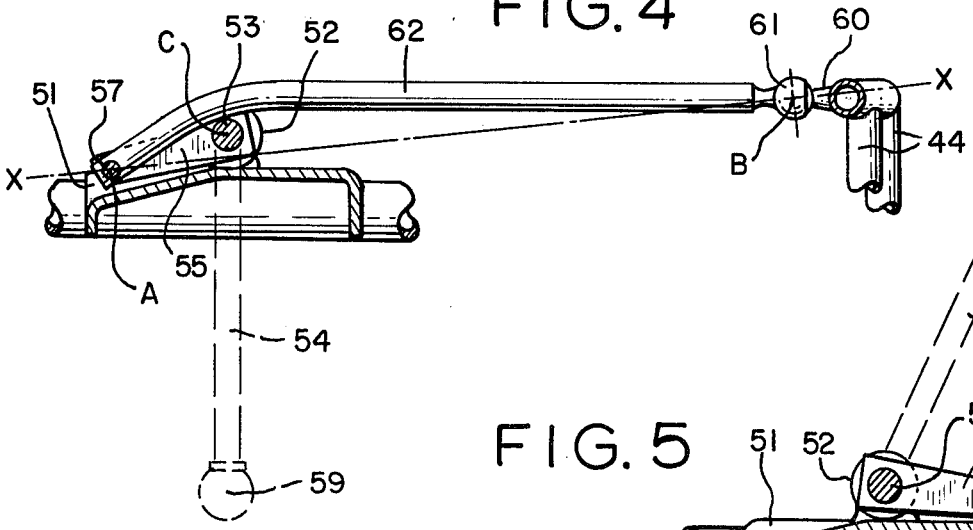
FIG. 4 is a side elevational view of the lever and link mechanism shown in FIG. 3.
Figure 5:
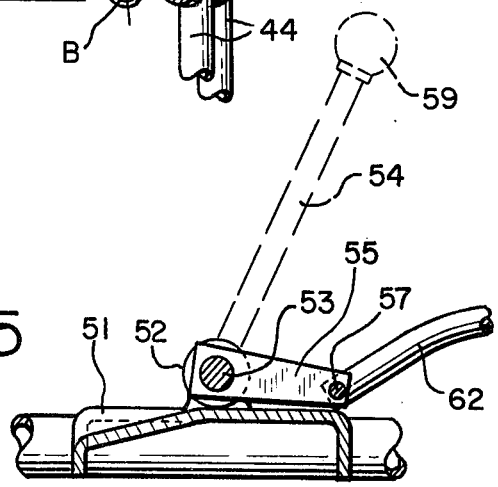
FIG. 5 is a fragmentary view of the mechanism shown in FIG. 4 with the parts in open-gate position.

The mechanism for opening and closing the exit gate members will now be described. As shown in FIGS. 1 and 6, a plate 50 is mounted on and bridged between the top rails 20 and 21 and is fastened thereto by welding, bolting or other suitable means. The plate 50 is generally flat on its top surface except for the two recesses 51—51 formed at the inner top edge thereof and except for the two hinge bearings 52—52. Rotatably mounted in hinge bearing 52—52 is a rod 53 terminating at least at one end thereof in a handle extension 54 preferably at right angles to the axis of rod 53 and preferably in a downward direction when the rod 53 is in closed-gate position. The extension 54 serves as a handle to be grasped by the person who is operating the exit gate members 40 and 41. At the locations of each of the recesses 51—51 a pair of radially extending arms 55—55 are provided rigidly attached to the rod 53 in spaced relation and equipped with aligned openings 56—56 to accommodate pivot bolts 57 as best shown in FIGS. 3, 4 and 5. These arms form with the rod and operating lever. Each of the gate members is provided at its upper end with an inwardly extending projection 60—60 terminating in a ball for cooperating with a truncated spherical socket to constitute a universal joint 61—61 which serve to connect the gate members respectively with links 62—62, the opposite ends of which are pivoted respectively between the pairs of arms 55—55 extending from the rod 53 by the pivot bolts 57—57. It should be noted that the pivot connection between the links 62—62 and the associated pair of arms 55—55 must be sufficiently loose to permit of some lateral freedom that will be required when the links are moving to open-gate position. The amount of lateral motion required can be reduced by making projections 60—60 longer and by selecting a length for the links 62—62 which does not move the gates to open position beyond that of being parallel to the side walls of the enclosure device. As shown in FIG. 4, the links 62—62 are preferably curved slightly downwardly so that the inner ends of the links pass over the rod 53 and thence downwardly to the pivot bolts 57—57 when the pairs of arms 55—55 are disposed in the recesses 51—51. Preferably the arms 55—55 are so mounted on the rod 53 that the extension handle 54 is disposed downwardly when the gates are in closed position.

In FIG. 4 the axis of the pivot bolts 57—57 is represented as A, one axis of universal joints 61—61 as B, and the axis of the rod 53 as C. It will be noted, therefore, that when the gates are in closed position, the point C lies above the straight line X—X passing through points A and B. Accordingly when the gates are moved from open position to closed position, the operating mechanism comprising the handle extension 54, the rod 53, the arms 55—55, and the links 62—62 move from the positions they occupy as shown in FIG. 5 to their positions as illustrated in FIG. 4 and that in making this change the arms 54—54 swing in an arc around pivot point C until points A, B and C all lie in the same straight line and then downwardly beyond the straight line position where point C is disposed above the line X—X as shown in FIG. 4. It will be recognized that this mechanism moves the parts to positions beyond that of dead center so that the mechanism itself creates a locking device which maintains the gate members locked in closed position against opening accidentally as well as against any pressure exerted on the gate members by an animal confined in the enclosure device.

To intentionally open the gates it is only necessary to lift the handle extension 54 by that amount necessary to move point A above the straight line or dead center position for points A, B and C and from that point on any pressure on the gates exerted by the confined animal serves to quickly move the gates to full open position. When the arms 55—55 have moved slightly more than 180°, they will contact the plate 50 on the side opposite that of the recesses 51—51 and come to rest with the point A disposed below a straight line passing through points B and C or in other words in a position again past dead center. Thus, the gates in such case are effectively held open until they are intentionally closed manually by the operator moving the handle extension 54.

It should be understood that instead of having a single handle extension as shown at 54 in the drawings a second and similar handle (not shown) advantageously can be provided at the other end of rod 53 in order that the operator may stand on either side of the enclosure device and operate the exit gates.

It should be further understood that the operating handle provided by such an extension, if desired, can be made as a T with a like extension from the end of the rod 53 disposed 180° opposite to that of the extension 54 shown in FIG. 1. The advantage would be that when the gates are in open position an operating handle would be presented at a lower position, that is to say, by extending in the downward direction from the center of the rod 53, thus making it unnecessary to reach so high when manually closing the gates. In cases where the weight of the extension handle 54 is desired to render more positive the closing action, a weight or end ball 59 may be provided on the end of the extension handle 54 and in such case it may not be desirable to counterbalance such weight with an oppositely disposed handle in the form of a T as above suggested.

The alternative form shown in FIGS. 6, 7, and 8 will now be described. As above pointed out, it is desirable in some instances to provide an enclosure device of the type here referred to which has adjustable side walls. In order to accomplish this objective, the frame structure shown in FIG. 6 may be employed with side walls constructed as shown in FIG. 7 when the construction is assembled in the manner illustrated in FIG. 8. In the illustration of FIGS. 6, 7, and 8, those parts shown which are the same as those illustrated in the other figures of the drawings are identified by the same reference numerals heretofore used in describing the structure of FIGS. 1 to 5 inclusive.

Referring now to FIG. 6, it will be noted that the frame theredisclosed employs base members 110 and 111 which are similar to the base members 10 and 11 except that a series of slots or openings 70 and 71 are provided in base member 110 and a similar series of slots or openings 72 and 73 are provided in base member 111.

Also in this form of the invention lower horizontal rails 126 and 127 extend between corner posts 12 and 14 and 13 and 15 respectively. The side walls employed may be constructed as illustrated in FIG. 7 and as shown consist of spaced uprights 74—74 connected by a series of horizontal rails 75—75. These uprights and rails may be of any crosssectional shape but advantageously may be formed of tubular metal stock assembled as by welding or by any other suitable means. The lower ends of the uprights may be flattened as shown in FIG. 7 at 76 and 77 so that the lower ends of the uprights constitute extensions which may be inserted in any selected pair of slots or openings 70 and 72 in the base members 110 and 111 and be free to be moved laterally as desired at the top. The upper ends of the uprights 74 are preferably flattened and are provided with elongated slots 78 and 79 adapted to cooperate with slots 80 and 81 extending all the way through the corner posts 12 and 14 respectively so as to permit the upper end of the side wall to be fastened in its selected position by nuts and bolts as shown at 82 and 83 in FIG. 7. The bolts are of sufficient length to pass through the uprights 74 as well as through the corner posts 12 and 14. The cooperating slots 78, 79, 80 and 81 are of sufficient length to provide a satisfactory fastening of the uprights 74 at their upper ends irrespective of the particular pair of slots or openings 70 and 72 selected to receive the flattened extended ends 76 and 77 of the uprights 74. Furthermore, irrespective of the adjustment at the base that is adjacent the feet of the confined animal the slots 78, 79, 80, and 81 are of sufficient length to permit the desired adjustment at the top to accommodate the body of animals of different sizes.

Whereas only one adjustable side wall has been shown and described, it is to be understood that a similarly constructed and installed side wall is provided for the opposite side of the enclosure device.

In addition to the foregoing, it is to be understood that the enclosure of this invention is to be used in conjunction with conventional means for releasing a barrier line after the steer or calf has advanced into the area a predetermined distance to thereby permit the start of the mounted cowboy or cowboys as prescribed by the rules of the particular contest. It is customary for such releasing means to also effect a highly visible movement of a signal flag to mark the instant of such release. The barrier line usually employed in this type of mechanism has a breakable link of string or the like which is readily parted by the advancing horse if the horse starts too soon, that is, before the barrier line is released by the advancing steer or calf. This releasing and signaling means is not specifically shown or described here, however, because it does not constitute any part of the present invention.

In use, the entrance gate can be opened when the exit gates are closed to allow a steer or calf to enter the enclosure. Due to the mechanical leverage provided by the double pulley and line arrangement the entrance gate can be easily lifted with a minimum of exertion.

Furthermore, it should be understood that the enclosure of this invention could be constructed with only a single exit gate although two gate members are preferable. In such event, the operating mechanism would consist of only a single link and pivoted arm assembly but of the same construction as that shown.

I claim:

1. An enclosure for a steer, calf, or like animal for use in performing contests at rodeos, comprising a rectangular cage-like structure having side walls, an entrance gate at one end and an exit gate at its opposite end, said exit gate comprising at least one rigid gate member hingedly supported on an upright post of said structure and adapted to swing to open and closed positions, means for operating said exit gate comprising a supporting plate secured to and bridging the space between the upper portions of said side walls, an operating rod pivoted on said plate and having an arm fixed thereto and extending at an angle therefrom, a link having one end pivotally connected to said arm and its other end pivotally connected to said exit gate, said link extending over said operating rod and downwardly with respect to the axis of said operating rod when said arm is in closed-gate position whereby a straight line passing through the axis of the pivotal connection between said arm and link and the axis of the pivotal connection between said link and gate lies below the axis of said operating rod and whereby said arm and link occupy relative positions beyond dead center for holding said exit gate locked against pressure applied to the inside of said exit gate, and a manually operable handle for said operating rod for rotating said rod and arm to lift the adjacent end of said link to unlock and open said gate.

2. The structure defined in claim 1 further characterized in that said exit gate comprises a pair of rigid gate members hinged as defined to swing toward and away from each other when closing and opening the exit gate respectively, each gate member being pivotally connected, respectively. by a link to an operating arm extending from said operating rod in the manner defined in claim 1 for locking said exit gate members in closed position and for opening and closing said exit gate members.

3. The structure defined in claim 1 further characterized in that, in open position, the axis of the pivotal connection between said arm and link lies below a straight line passing through the axes of the operating rod and the pivotal connection between said link and said gate, whereby said gate is locked in open position.

4. The structure defined in claim 1 further characterized in that said entrance gate is a vertically sliding gate member having a rope-like lifting means which when freed allows the gate to close the entrance of said enclosure by the action of gravity.

5. The structure defined in claim 4 further characterized in that a pair of pulleys are employed for said rope-like lifting means to provide a mechanical advantage to reduce the force required to lift said entrance gate.

6. The structure defined in claim 1 further characterized in that the side walls of said cage-like structure are adjustable toward and away from each other so as to better accommodate animals of different sizes.

7. The structure defined in claim 6 further characterized in that said cage-like structure has a base provided with a plurality of alternative pairs of openings therein and detachable side walls provided with bottom extensions adapted to fit respectively into selected pairs of said openings to adjust the space between said side walls adjacent the feet of an enclosed animal, and means for fixing the upper portion of said side walls to said cage-like structure in any selected position of the bottom extensions thereof in said base openings.

8. The structure defined in claim 7 further characterized in that the means for fixing the upper portions of said side walls to the cage-like structure has a plurality of alternative anchoring means which may be selected to vary the space between the upper portions of said side walls so as to accommodate animals of different sizes.

9. The structure defined in claim 8 further characterized in that the anchoring means for selectively varying the space between the upper portions of said side walls is capable of such adjustment irrespective of the particular adjustment selected for the bottom extensions of said side walls in said base openings.

* * * * *